US009045249B2

(12) United States Patent
Miura et al.

(10) Patent No.: US 9,045,249 B2
(45) Date of Patent: Jun. 2, 2015

(54) SYNTHETIC RESIN CONTAINER HAVING PRESSURE REDUCING/ABSORBING CAPABILITY IN THE BOTTOM

(75) Inventors: Masaki Miura, Yokohama (JP); Kazushi Matsukiyo, Yokohama (JP); Yuuta Murayama, Yokohama (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 0 days.

(21) Appl. No.: 14/354,295

(22) PCT Filed: Sep. 4, 2012

(86) PCT No.: PCT/JP2012/072427
§ 371 (c)(1),
(2), (4) Date: Apr. 25, 2014

(87) PCT Pub. No.: WO2013/073261
PCT Pub. Date: May 23, 2013

(65) Prior Publication Data

US 2014/0291280 A1 Oct. 2, 2014

(30) Foreign Application Priority Data

Nov. 18, 2011 (JP) ..... 2011-253089

(51) Int. Cl.
*B65D 1/02* (2006.01)

(52) U.S. Cl.
CPC ..... *B65D 1/0284* (2013.01); *B65D 1/0276* (2013.01); *B65D 2501/0036* (2013.01)

(58) Field of Classification Search
CPC ... B65D 1/0284; B65D 1/0261; B65D 1/0223
USPC ..... 215/374, 373, 372, 371, 377, 376; 220/606, 605, 604, 608, 609; D9/520, D9/548
See application file for complete search history.

(56) References Cited

U.S. PATENT DOCUMENTS 4,993,566 A 2/1991 Eberle
4,993,567 A * 2/1991 Eberle, Jr. ..... 215/373
(Continued)

FOREIGN PATENT DOCUMENTS

JP 61-144012 U 9/1986
JP 62-28335 A 2/1987
(Continued)

OTHER PUBLICATIONS

International Search Report of PCT/JP2012/072427 dated Dec. 18, 2012.

*Primary Examiner* — Robert J Hicks
(74) *Attorney, Agent, or Firm* — Sughrue Mion, PLLC

(57) ABSTRACT

A synthetic resin container with a bottom structure in which forms, in the bottom portion thereof, an outer circumferential wall that is continuing from the body portion, an annular leg portion inclusive of a grounding portion and an inner circumferential wall, and a raised bottom portion positioned over the grounding portion on the inside of the inner circumferential wall of the leg portion. The raised bottom portion protrudes downward beyond the root portion where the leg portion is continues to the inner circumferential wall, a plurality of arcuate protuberances are formed in a spiral shape heading from the outer edge of the central portion of the raised bottom portion toward the outer circumferential side, and arcuate dents are formed among the arcuate protuberances that neighbor each other.

7 Claims, 4 Drawing Sheets

(56) References Cited

U.S. PATENT DOCUMENTS

| | | | |
|---|---|---|---|
| 2004/0232103 | A1 | 11/2004 | Lisch et al. |
| 2005/0196569 | A1 | 9/2005 | Lisch et al. |
| 2006/0006133 | A1 | 1/2006 | Lisch et al. |
| 2009/0159556 | A1 | 6/2009 | Patcheak et al. |
| 2009/0242575 | A1 | 10/2009 | Kamineni et al. |
| 2011/0017700 | A1 | 1/2011 | Patcheak et al. |
| 2011/0233166 | A1 | 9/2011 | Hiromichi et al. |
| 2012/0248059 | A1 | 10/2012 | Saito et al. |
| 2012/0248060 | A1 | 10/2012 | Saito et al. |
| 2013/0001235 | A1 | 1/2013 | Patcheak et al. |
| 2013/0240477 | A1 | 9/2013 | Saito et al. |

FOREIGN PATENT DOCUMENTS

| | | | |
|---|---|---|---|
| JP | 03-187830 | A | 8/1991 |
| JP | 2998559 | B2 | 1/2000 |
| JP | 2004-276602 | A | 10/2004 |
| JP | 2008-178994 | A | 8/2008 |
| JP | 2008-539141 | A | 11/2008 |
| JP | 2010-126184 | A | 6/2010 |
| JP | 2011-515295 | A | 5/2011 |

* cited by examiner

SYNTHETIC RESIN CONTAINER HAVING PRESSURE REDUCING/ABSORBING CAPABILITY IN THE BOTTOM

CROSS REFERENCE TO RELATED APPLICATIONS

This is a National Stage of International Application No. PCT/JP2012/072427 filed Sep. 4, 2012, claiming priority based on Japanese Patent Application No. 2011-253089 filed Nov. 18, 2011, the contents of all of which are incorporated herein by reference in their entirety.

TECHNICAL FIELD

This invention relates to a synthetic resin container having pressure reducing/absorbing capability in the bottom portion thereof. More specifically, the invention relates to a synthetic resin container having a bottom structure that is capable of varying responsive to a change in the internal pressure.

BACKGROUND ART

Owing to their light weight and excellent shock resistance, synthetic resin containers have been widely used as containers for packing a variety of liquids. Specifically, stretch-formed containers obtained by stretch-blow-forming a polyethylene terephthalate (PET) feature transparency, gas-barrier property, light weight, shock resistance and suitable degree of rigidity in combination, have been widely used as containers for containing liquid contents, and are replacing for the glass bottles that were so far used for containing seasonings and the like contents.

It is a widely accepted practice even for the synthetic resin containers such as of polyesters to be hot-filled with the contents to improve preservation of the contents. The synthetic resin containers, however, are necessarily accompanied by deformation due to a reduction in the pressure since the volume of the content shrinks as it cools down. To prevent this, it has, usually, been attempted to provide the body portion of the container with a panel portion via rib portions so that the panel portion absorbs the deformation caused by a reduction in the pressure (patent document 1, etc.).

However, the contents such as seasonings and the like mentioned above must maintain appearance or images of the traditionally used products by, for example, sticking roll labels onto the glass bottles. Therefore, providing the body portion with the panel portion for reducing or absorbing the pressure is not desirable since it makes it difficult to stick the labels. Besides, the body portion that is irregularly deformed due to a reduction in the pressure can be discerned at a glance. It has, therefore, been desired to provide an art that is capable of coping with a change in the internal pressure without affecting the appearance.

To satisfy the above requirements, there have been proposed a variety of synthetic resin containers provided with the pressure reducing/absorbing capability in the bottom portion thereof without providing the body portion with the pressure reducing/absorbing panel (patent documents 2 and 3).

Prior Art Documents

Patent document 1: Japanese Patent No. 2998559
Patent document 2: JP-T-2008-539141
Patent document 3: JP-A-2008-178994

OUTLINE OF THE INVENTION

Problems that the Invention is to Solve

The synthetic resin containers having bottom shapes disclosed in the patent documents 2 and 3 are designed to cope with a change in the internal pressure by permitting the tilted bottom surface to be inverted utilizing a fulcrum formed in the bottom portion as an axis. In exhibiting their pressure reducing/absorbing capability, however, if the thickness is locally deviated along the radial line from the central portion of the bottom, then the strength becomes different on the tilted bottom surface giving rise to the occurrence of irregular deformation, and the desired pressure reducing/absorbing capability cannot be exhibited maintaining stability.

With the bottom shape described in the patent document 3, a separate apparatus is required for pushing up the inverted tilting portion in conveying the containers in an erected state. If the containers are to be conveyed being held by a gripper or the like without pushing up the inverted tilting portion of the bottom, then the apparatus becomes complex and the productivity becomes inefficient.

In dealing with the synthetic resin containers having pressure reducing/absorbing capability in the bottom portion, therefore, it is an object of the present invention to provide a synthetic resin container with a bottom structure in which a bottom portion uniformly and mildly deforms responsive to a change in the internal pressure, and exhibits pressure reducing/absorbing capability to reliably cope with even a large change in the internal pressure.

Another object of the present invention is to provide a synthetic resin container which prevents the body portion from varying irrespective of a change in the pressure in the container, which can be excellently conveyed maintaining the state of being erected and, therefore, which can be excellently produced.

Means for Solving the Problems

According to the present invention, there is provided a synthetic resin container forming, in the bottom portion thereof, an outer circumferential wall that is continuing from the body portion, an annular leg portion inclusive of a grounding portion and an inner circumferential wall, and a raised bottom portion positioned over the grounding portion on the inside of the inner circumferential wall of the leg portion, wherein the raised bottom portion is protruding downward beyond the root portion where the leg portion is continuing to the inner circumferential wall, a plurality of arcuate protuberances are formed in a spiral shape heading from the outer edge of the central portion of the raised bottom portion toward the outer circumferential side, and arcuate dents are formed among the arcuate protuberances that are neighboring each other.

In the synthetic resin container of the present invention, it is desired that:

1. A plurality of annular curved portions are formed in the arcuate protuberances and in the arcuate dents, the plurality of annular curved portions being in concentric with the central portion and curving downward;
2. The arcuate dents have branched dents that are extending in a direction nearly opposite to the spiraling direction and toward the outer circumference on the outer circumferential side in the radial direction, and divided protuberances are formed between the arcuate dents and the branched dents;

3. The centers of the arcuate dents and of the branched dents at the outer ends thereof in the direction of width are arranged maintaining an equal distance at the end on the outer circumferential side of the raised bottom portion;
4. The central portion of the raised bottom portion is protruding downward or upward;
5. The arcuate dents and the branched dents have rough surfaces;
6. The arcuate protuberances have rough surfaces; and
7. The inner circumferential wall of the leg portion has a rough surface.

Effects of the Invention

The synthetic resin container of the present invention has a downwardly protruding raised bottom portion on the inside of annular leg portion that is formed in the bottom portion of the container, and has dents and protuberances of predetermined shapes formed in the raised bottom portion, permitting the raised bottom portion to move upward or downward (inward or outward) responsive to a change in the internal pressure. Upon forming the dents and protuberances of predetermined shapes, further, the raised bottom portion has an increased area and a decreased thickness to reliably form a region that can move responsive to even a large change in the internal pressure.

Besides, the dents and protuberances of predetermined shapes formed in the raised bottom portion are serving as the plurality of arcuate protuberances and arcuate dents that are formed in a spiral shape. As compared to, for example, the case where the dents and protuberances are radially formed from the central portion, therefore, the raised bottom portion is allowed to deflect and move uniformly and mildly responsive to a change in the internal pressure, effectively preventing the raised bottom portion from irregularly deforming or from quickly inverting.

Upon forming, in the bottom portion, the annular leg portion that does not contribute to reducing or absorbing the pressure, further, it is made possible to maintain the height of the container constant at all times irrespective of a change in the internal pressure enabling the container to maintain self-standing performance and to excel in transportability. Besides, there is no need of forming a panel on the body portion for reducing or absorbing the pressure making it possible to maintain appearance and freedom for sticking labels.

Further, the arcuate protuberances and arcuate dents are forming a plurality of annular curved portions that are in concentric with the central portion and are curving downwards. When the pressure is reduced or absorbed in the container, therefore, the force of compression that is produced acts mildly on the raised bottom portion. Being aided by the arcuate protuberances and arcuate dents formed in a spiral shape, therefore, the raised bottom portion mildly moves inward in the container to stably exhibit the action of reducing and absorbing the pressure in a desired manner. Further, the raised bottom portion as a whole possesses improved shape-retaining property. Even in case the container is hot-filled with the content and is, therefore, heated while receiving the load due to the weight of the content, or the pressure therein becomes positive in excess of the atmospheric pressure due to vapor pressure of the content filled therein, the raised bottom portion is effectively prevented from abnormally expanding outward of the container.

On the outer circumferential side of the arcuate dents in the radial direction, further, there are formed branched dents extending in a direction nearly opposite to the spiraling direction and toward the outer circumference to relax the force of compression, and enabling the raised bottom portion to move more smoothly. Moreover, the centers of the arcuate dents and branched dents at their outer ends in the direction of width are arranged maintaining an equal distance at the end on the outer circumferential side of the raised bottom portion to relax the force of compression enabling the raised bottom portion to move more smoothly.

The central portion of the raised bottom portion is formed to protrude downward or upward (outward or inward) of the raised bottom portion. Namely, the central portion and the vicinities thereof are formed more thinly to reliably secure a region that is capable of moving responsive to even a large change in the internal pressure, the region being further capable of easily undergoing deformation.

Further, the arcuate dents, branched dents, arcuate protuberances, and inner side of the annular leg portion formed in the raised bottom portion, have rough surfaces. Namely, the synthetic resin containers of the invention are formed by using a metal mold and, here, the bottom surface of the metal mold has been roughly machined. Therefore, the bottom portions of even complex shapes exhibit improved parting property to excel in productivity.

MODES FOR CARRYING OUT THE INVENTION

Figure 1:
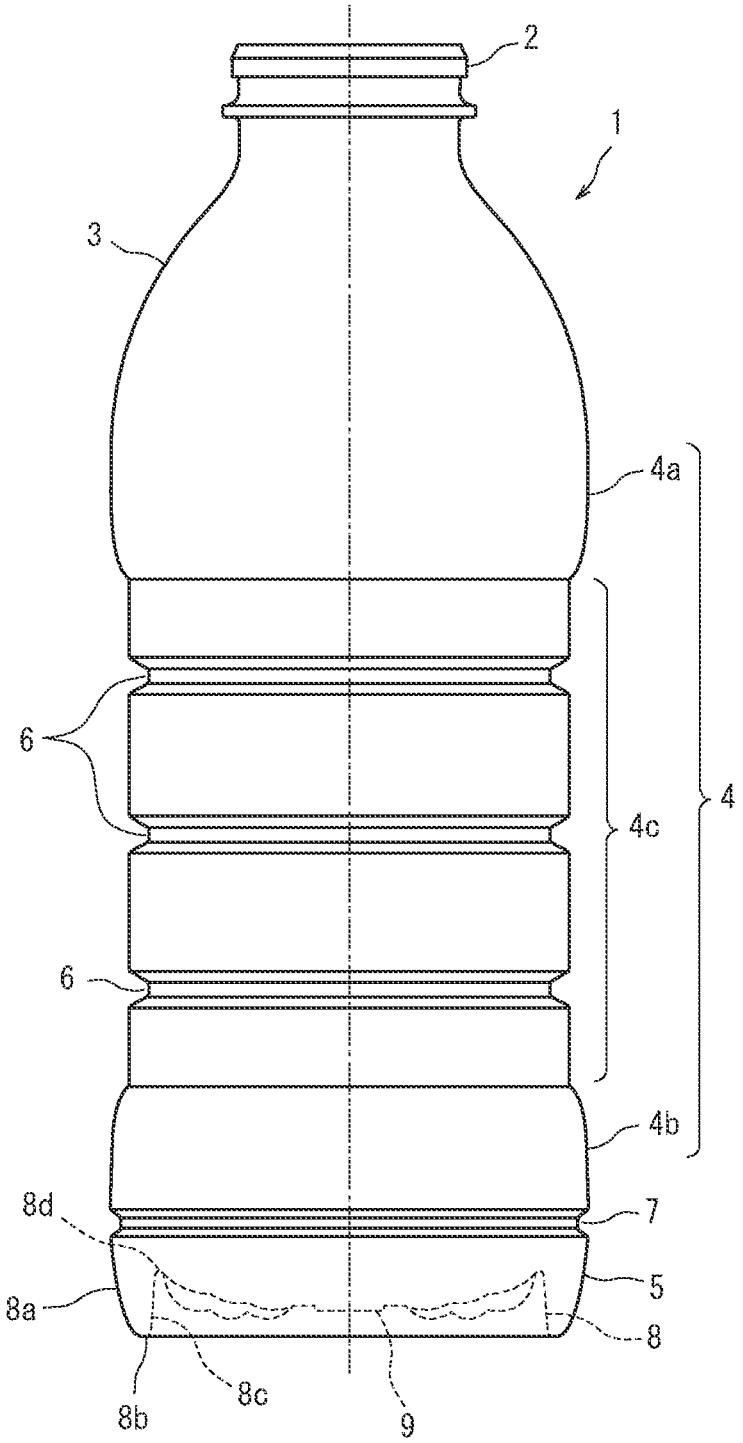
[FIG. 1] is a side view of a synthetic resin container of the present invention.

Preferred embodiments of the synthetic resin container of the present invention will now be concretely described with reference to the accompanying drawings.

A synthetic resin container 1 (hereinafter also called container 1) of the present invention shown in FIG. 1 includes a mouth portion 2, a shoulder portion 3, a body portion 4 and a bottom portion 5. The body portion 4 includes an upper body portion 4*a* continuing from the shoulder portion 3, a lower body portion 4*b* continuing to the bottom portion, and a central body portion 4*c* positioned between the upper body portion 4*a* and the lower body portion 4*b*.

The central body portion 4*c* has three circumferential ribs 6, 6, 6 formed in parallel and maintaining an equal distance to maintain the mechanical strength of the body portion and the shape thereof against the deformation caused by the internal pressure. Further, the outer circumferential surface thereof excluding the ribs 6 is formed straightly in the axial direction enabling a label (not shown) to be wrapped around the body portion.

In the concrete embodiment shown, another rib 7 is formed between the lower body portion 4*b* and the bottom portion 5 to clearly distinguish the body portion 4 and the bottom portion 5 from each other. However, the body portion and the bottom portion do not necessarily have to be distinguished from each other.

The bottom portion 5 includes an annular leg portion 8 and a raised bottom portion 9 positioned on the inside of the annular leg portion 8. The annular leg portion 8 is positioned below the rib 7, and includes an outer circumferential wall 8*a* that is continuing from the body portion 4 in a manner that the outer diameter of the container decreases as it goes down, a grounding portion 8*b*, and an inner circumferential wall 8*c* that rises upward from the grounding portion 8*b*. This makes it possible to maintain the height of the container 1 constant at all times irrespective of a change in the internal pressure, enabling the container 1 to maintain self-standing performance and to excel in transportability.

As will be obvious from FIG. 1 and FIG. 3(A), the raised bottom portion 9 is positioned over the grounding portion 8*b*, and has a shape that protrudes down beyond a root portion 8*d* of the annular leg portion 8 toward a central portion 10 of the raised bottom portion 9. As is obvious from FIG. 2 and FIG. 3(A), further, the central portion 10 of the raised bottom portion 9 is formed nearly flat. Further, a thick portion 11 is formed at the center of the central portion 10 and has a thickness larger than the thickness of the central portion 10.

Figure 2:
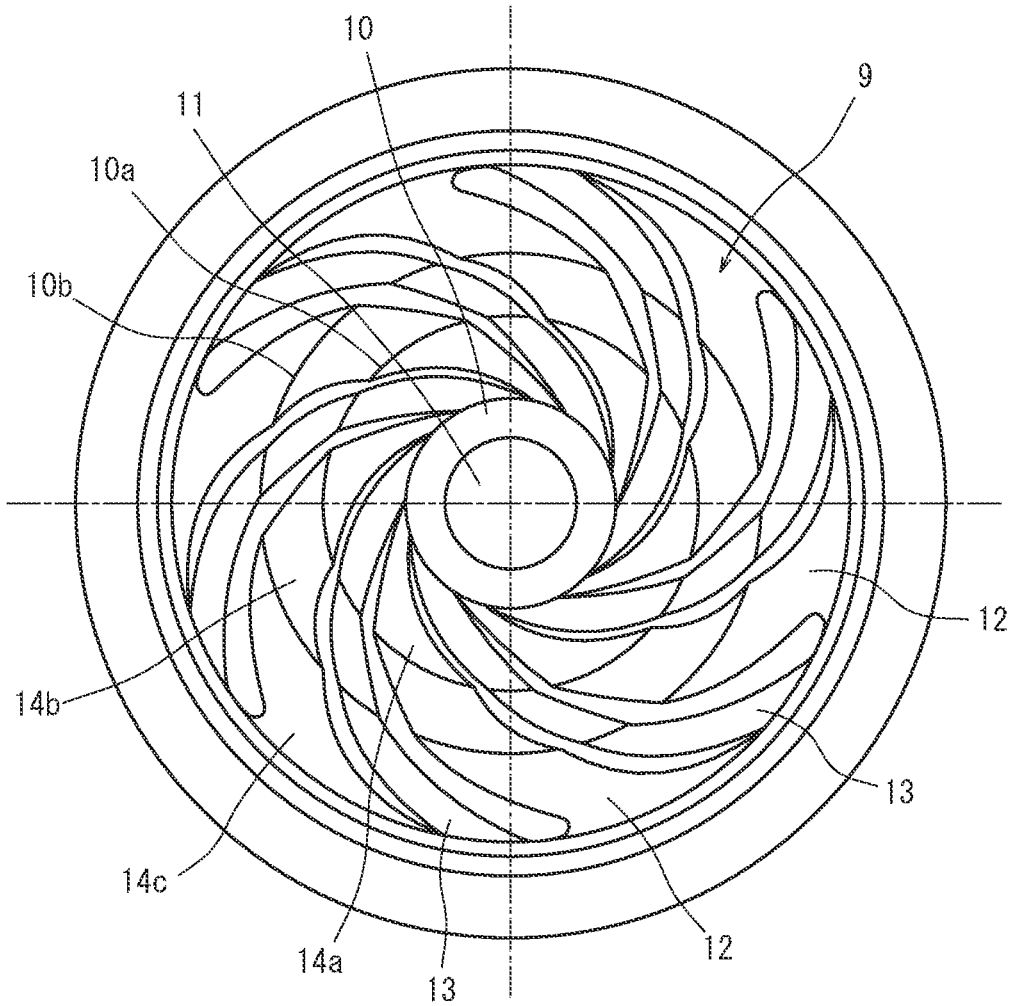
[FIG. 2] is an enlarged view showing the shape of the bottom portion of the synthetic resin container shown in FIG. 1.

As is obvious from FIG. 2, further, the synthetic resin container 1 of the present invention has a plurality of arcuate protuberances 12, 12, - - - (hereinafter called arcuate protuberances 12) formed in a spiral shape turning clockwise from the outer edge of the central portion 10 toward the outer circumferential side. Further, a plurality of arcuate dents 13, 13, - - - (hereinafter called arcuate dents 13) are formed from the outer edge of the central portion 10 toward the outer circumferential side among the neighboring arcuate protuberances 12. In this embodiment, the arcuate protuberances 12 and the arcuate dents 13 are arranged in a number of six, respectively, having their both ends on the side of the central portion and on the outer circumferential side in the bottom portion, being narrower and sharper than those at their central portions.

Upon forming dents and protuberances of predetermined shapes as described above, the raised bottom portion 9 possesses an increased surface area and a decreased thickness, and becomes capable of moving upward or downward responsive to a change in the internal pressure. Further, it is allowed to reliably secure a region that is capable of moving responsive to even a large change in the internal pressure, the region being further capable of easily undergoing deformation. Besides, the dents and protuberances of predetermined shapes formed in the raised bottom portion are the plurality of arcuate protuberances 12 and arcuate dents 13 that are formed in a spiral shape, permitting the raised bottom portion 9 to deflect and move uniformly and mildly responsive to a change in the internal pressure as compared to when the dents and protuberances are formed, for example, in a radial manner from the central portion 10, and preventing the raised bottom portion 9 from irregularly deforming or quickly inverting.

As is obvious from FIG. 3(A), further, the raised bottom portion 9 forming the arcuate protuberances 12 and the arcuate dents 13, is sectionalized by grooves 10*a* and 10*b* formed in the circumferential direction in concentric with the outer edge of the central portion 10 thereby to form a plurality of annular curved portions 14*a*, 14*b* and 14*c* (three in this embodiment) in the radial direction. The annular curved portion 14*a* is connecting to the outer edge of the central portion 10 and the annular curved portion 14*c* is connecting to the root portion 8*d*, respectively.

If the pressure is reduced or absorbed in the container 1, therefore, the force of compression that is produced acts mildly on the raised bottom portion 9. Being aided by the arcuate protuberances 12 and arcuate dents 13 formed in the spiral shape, therefore, the raised bottom portion 9 mildly moves upward (inward) in the container 1 to stably exhibit the action of reducing/absorbing the pressure in a desired manner. Further, the raised bottom portion 9 as a whole possesses improved shape-retaining property. Even in case the container 1 is hot-filled with the content and is, therefore, heated while receiving the load due to the weight of the content, or the pressure therein becomes positive in excess of the atmospheric pressure due to vapor pressure of the content filled therein, the raised bottom portion 9 is effectively prevented from abnormally expanding downward (outward) of the container 1.

In the synthetic resin container 1 of the present invention as is obvious from the behavior of the bottom portion responsive to changes in the internal pressure shown in FIGS. 3(A) to 3(E), if the pressure reduces in the container 1, the raised bottom portion 9 having the plurality of arcuate protuberances 12 and arcuate dents 13, deflects uniformly and mildly, i.e., moves in a manner to rise in the container 1 to reduce and absorb the pressure.

Here, the grooves 10*a* and 10*b* in the circumferential direction serve as fulcrums when the raised bottom portion 9 deflects. It is, therefore, desired to decrease the thickness of the grooves 10*a* and 10*b* in the circumferential direction. The raised bottom portion 9, therefore, is allowed to easily deflect and more easily move upward in the container 1.

Figure 3:
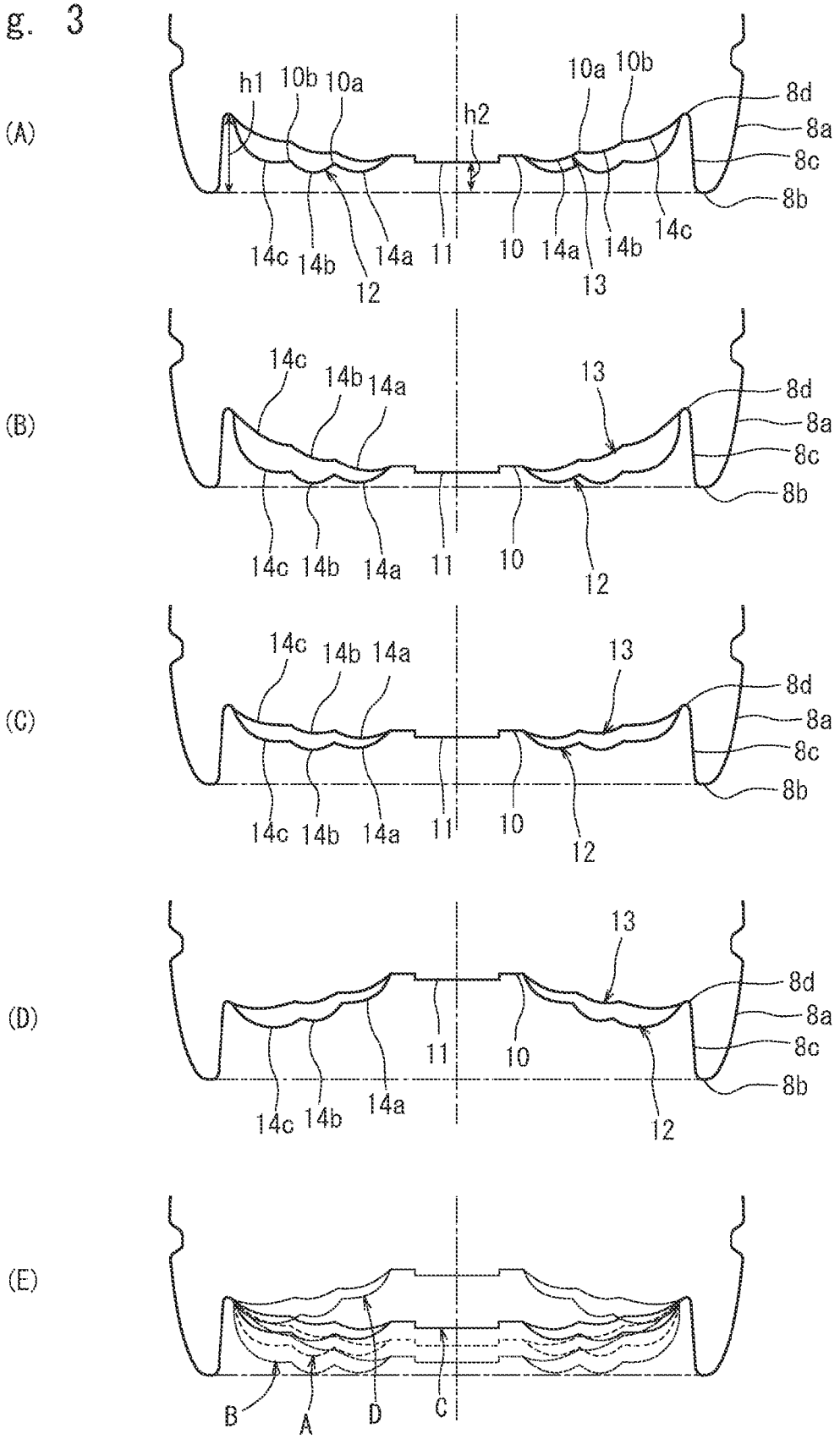
[FIG. 3] includes partial sectional views for illustrating the behavior of the bottom portion of the synthetic resin container shown in FIG. 1, wherein (A) is a view in an empty state, (B) is a view in a state right after quasi-hot-filled (e.g., 72° C.), (C) is a view in a state where the pressure has been reduced after filled in (B), (D) is a view in a state where the pressure has been reduced right after hot-filled (e.g., 85° C.), and (E) is a view overlapping (A) to (D) one upon the other.

Referring to FIG. 3 illustrating the movement of the bottom portion responsive to changes in the pressure in the synthetic resin container of the invention, (A) is a partial sectional view showing an empty state, (B) is a partial sectional view showing a state right after filled at a quasi-high temperature (e.g., 72° C.), (C) is a partial sectional view showing a state where the pressure has been reduced after being filled in (B), (D) is a partial sectional view showing a state where the pressure has been reduced right after filled at a high temperature (e.g., 85° C.), and (E) is a view overlapping (A) to (D) one upon the other. These partial sectional views are going through the center along the arcuate protuberances 12 and the arcuate dents 13 that are symmetrically arranged with the central portion 10 as a base point.

Immediately after the synthetic resin container of the invention is filled with the content (B), the raised bottom portion 9 moves down beyond the empty state (A) due to the weight of the content irrespective of the temperature of filling. When the content is filled and sealed at a quasi-high temperature of 72° C. and is cooled so that the pressure reduces (C), however, the raised bottom portion 9 moves up slightly above the empty state (A) but still remains in a state of being protruded downward. Further, when the content is filled and sealed at a high temperature of 85° C. and is cooled so that the pressure reduces (D), the central portion 10 of the raised bottom portion 9 is positioned over the root 8*d* of the annular leg portion 9, and the vicinities thereof are greatly elevated on the inside of the root 8*d*.

As will be obvious from FIG. 3(E) which is overlapping these views, therefore, the synthetic resin container 1 of the present invention exhibits its ability of reducing and absorbing the pressure without causing the arcuate protuberances 12 and the arcuate dents 13 in the raised bottom portion 9 to be inverted. Besides, the raised bottom portion 9 from the annular curved portion 14*a* on the center side up to the annular curved portion 14*c*, undergoes the deformation so as to rise inward of the container 1. As compared to the conventional synthetic resin containers having a pressure-reducing/absorbing bottom portion, therefore, the raised bottom portion 9 moves mildly; i.e., the raised bottom portion 9 is allowed to move upward to a large extent to cope with a large change in the internal pressure. This makes it possible to reduce and absorb the pressure as desired yet reducing the load exerted on the container bottom portion by the deformation of the bottom portion.

Figure 4:
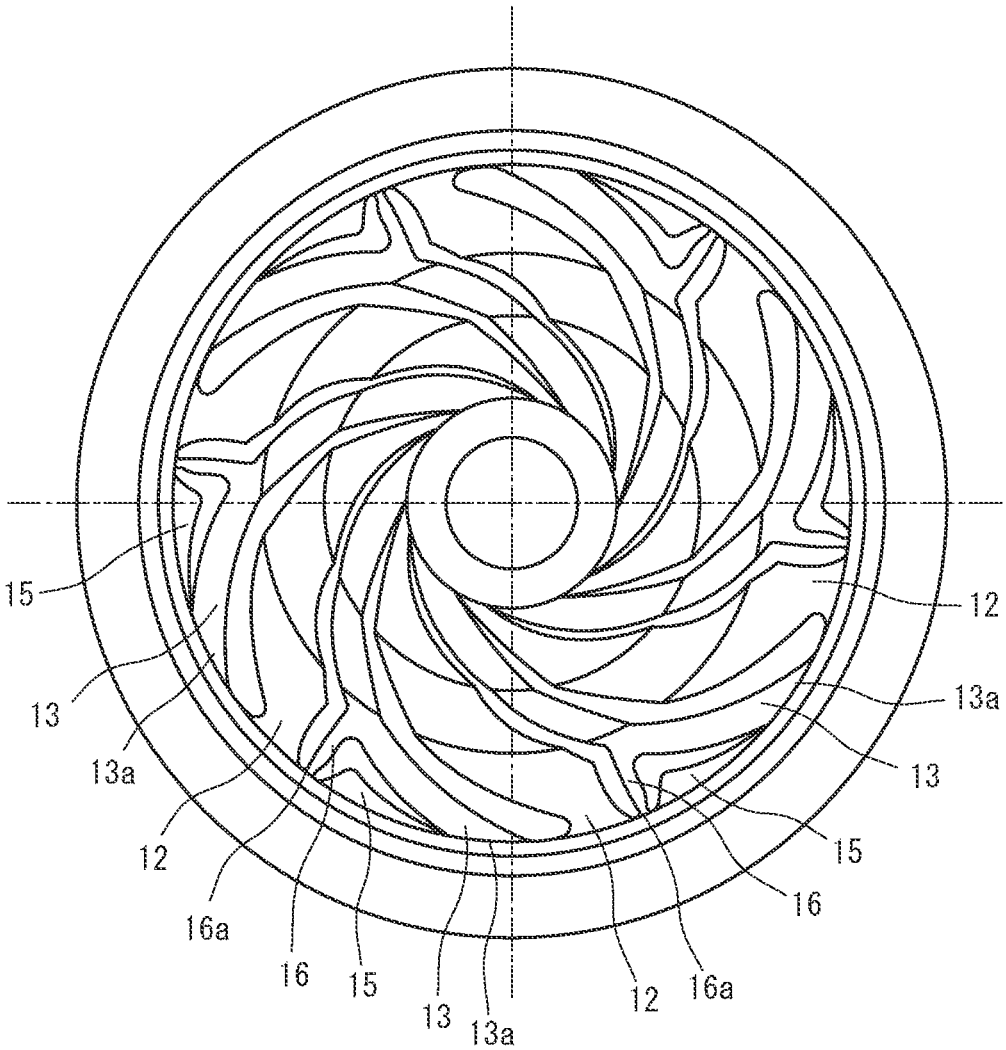
[FIG. 4] is an enlarged view showing the shape of the bottom portion of the synthetic resin container according to another embodiment of the invention.

Referring to FIG. 4 illustrating another embodiment of the invention, further, branched dents 16, 16, - - - (hereinafter referred to as branched dents 16) are formed on the outer circumferential side of the arcuate dents 13 in the radial direction, and are extending in a direction nearly opposite to the spiraling direction and toward the outer circumference. The branched dents 16 divide the arcuate protuberances 13, and divided protuberances 15 are formed between the arcuate dents 13 and the branched dents 16. This constitution relaxes the force of compression that acts on the raised bottom portion 9 when the pressure is to be reduced and absorbed in the container 1, permitting the raised bottom portion 9 to move more smoothly. Here, the spiraling direction stands for a direction in which the arcuate protuberances 12 and the arcuate dents 13 formed in the spiral shape are extending from the outer circumferential side toward the central portion 10.

Further, it is particularly desired that the ends 13*a*, 13*a*, - - - of the arcuate dents 13 on the outer circumferential side and the ends 16*a*, 16*a*, - - - of the branched dents 16 on the outer circumferential side, are in contact with the end on the outer circumferential side (the root 8*d*) of the raised bottom portion 9 and that the central positions of the respective ends 13*a* and 16*a* thereof in the direction of width are arranged maintaining an equal distance (equally divided into 12 in this embodiment) at the end on the outer circumferential side (the root 8*d*) of the raised bottom portion 9. This relaxes the force of compression and permits the raised bottom portion 9 to move more smoothly.

Further, with the central portion 10 of the raised bottom portion 9 protruding downward or upward (outward or inward) of the raised bottom portion 9, it is allowed to further decrease the thickness of the raised bottom portion 9 and to reliably secure a region that is capable of moving responsive to even a large change in the internal pressure, the region being further capable of easily undergoing deformation.

The synthetic resin container of the invention is not limited to the above-mentioned embodiments only but can be modified in a variety of ways.

Namely, in the embodiments shown, the arcuate protuberances and the arcuate dents are formed in a number of 6, respectively, and the annular curved portions are formed in a number of 3, to which only, however, the invention is in no way limited. Though dependent also upon the diameter of the raised bottom portion, it is desired that the arcuate protuberances and the arcuate dents are formed in numbers in a range of 4 to 8 and the annular curved portions are formed in numbers in a range of 2 to 6 from the standpoint of increasing the surface area of the raised bottom portion while reducing the thickness thereof to reliably secure a region that is capable of moving responsive to even a large change in the internal pressure yet maintaining formability.

Here, if the numbers of the arcuate protuberances and the arcuate dents are less than 4, respectively, the raised bottom portion becomes less flexible than that of when the numbers thereof are in the above-mentioned ranges, and the ability to reduce and absorb the pressure may decrease. Further, if the numbers of the arcuate protuberances and the arcuate dents exceed 8 or if the number of the annular curved portions exceed 6, then the raised bottom portion assumes a higher degree of freedom in the shape than that of when the numbers thereof are lying in the above-mentioned ranges, and irregular (e.g., asymmetrical) deformation may result at the time of undergoing deformation to reduce the pressure.

It is, further, desired that the plurality of annular curved portions have nearly the same width in the radial direction to produce uniform deformation.

It is desired that the raised bottom portion has an outer diameter which is 85 to 95% of the diameter of the grounding portion of the bottom portion from the standpoint of maintaining self-standing performance of the container and ability of reducing and absorbing the pressure. It is, further, desired that the central portion of the raised bottom portion has an outer diameter which is 20 to 35% of the outer diameter of the raised bottom portion.

In the embodiments shown, further, the central portion of the raised bottom portion is formed nearly flat but may protrude downward or upward (outward or inward) of the raised bottom portion. This makes it possible to further decrease the thickness of the central portion and to exhibit the ability of more reducing and absorbing the pressure.

In the synthetic resin container of the invention, further, it is desired that the bottom portion has a thickness which is equal to, or smaller than, the thickness of the thinnest portion of the body portion. Though dependent also upon the diameter of the raised bottom portion, it is desired that the thickness of the bottom portion is decreased to lie in a range of 0.2 to 0.3 mm.

In the invention, the shape of the raised bottom portion cannot be exclusively determined by the size and the like of the container. However, in the case of, for example, the synthetic resin container shown in FIG. 1 which is biaxially stretch-blow-formed and has a capacity of 400 ml, a container height of 176 mm, outermost diameters in the shoulder portion and the bottom portion of ϕ65.6 mm, and the outer diameter in the central body portion of ϕ60.5 mm, the raised bottom portion 9 is formed in a manner that, as shown in FIG. 3, the vertical distance h1 is 9 mm from the grounding portion 8*b* of the annular leg portion 8 to the root 8*d* and the vertical distance h2 is 4 mm from the grounding portion 8*b* to the central portion 10 of the raised bottom portion 9 in a state where the container 1 is empty. It is desired that the vertical distance h1 is in a range of 3 to 15 mm and the vertical distance h2 is in a range of 2 to 10 mm in a state where the container 1 is empty.

Here, if the vertical distance h1 is less than 3 mm, then the raised bottom portion may protrude beyond the grounding portion when it is thermally deformed by the hot-filling. Further, if the vertical distance h1 exceeds 15 mm, then the bottom portion may not be easily formed.

Further, if the vertical distance h2 is less than 2 mm, the raised bottom portion may protrude beyond the grounding portion when it is thermally deformed by the hot-filling. It is, further, desired that the vertical distance h1 and the vertical distance h2 are not less than 5 mm for the raised bottom portion 9 to exhibit the ability of reducing and absorbing the pressure. It is, therefore, desired that the vertical distance h2 does not exceed 10 mm.

The synthetic resin container of the present invention can be produced by a conventional method of producing synthetic resin containers so far as the container has the above-mentioned bottom shape. Here, what is important is that the raised bottom portion has a reduced thickness so that it can be moved up and down responsive to a change in the pressure in the container. It is, therefore, desired that the synthetic resin container of the invention is formed by the stretch-blow-forming method that is capable of thinly forming the raised bottom portion.

A preform comprising a thermoplastic polyester resin such as polyethylene terephthalate is stretch-blow-formed by using a metal bottom mold that is capable of imparting the above-mentioned bottom shape to the bottom portion of the container.

Here, the bottom portion is imparted with complex and fine dented and protruded shapes such as arcuate protuberances 12, arcuate dents 13 and annular curved portions 14*a*, 14*b* and 14*c* of spiral shapes. It is, therefore, desired that the metal bottom mold has a rough surface for improving its parting property. In particular, the surfaces of the arcuate dents 13 and branched dents 16 or of the arcuate protuberances 12 and divided protuberances 15 in the bottom portion, or the portions corresponding to the inner circumferential wall 8*c* of the annular leg portion 8, are protruding and denting, and may make it difficult to remove the bottle from the metal mold. From the standpoint of parting property, therefore, it is desired that the surfaces are formed rough on the portions corresponding to at least the arcuate dents 13 in the bottom portion and, further desirably, on the portions of the metal bottom mold corresponding to the above-mentioned portions. Therefore, the synthetic resin container that is formed, too, has rough surfaces on the arcuate dents 13 and branched dents 16, on the arcuate protuberances 12 and divided protuberances 15, and on the inner circumferential wall 8*c* of the annular leg portion 8 that come in contact with the metal bottom mold.

The synthetic resin container of the invention can be advantageously formed by using a thermoplastic polyester resin that has heretofore been used for the stretch-blow forming and, specifically, by using an ethylene terephthalate type thermoplastic polyester. It is, of course, allowable to use other polyesters such as polybutylene terephthalate and polyethylene naphthalate, or blends thereof with a polycarbonate or an arylate resin.

Further, there can be used not only a single layer of the thermoplastic polyester resin but also a multi-layer structure of the above thermoplastic polyester resin and a gas-barrier resin. To impart heat resistance so to withstand the hot-filling at a high temperature, further, it is desired that the mouth portion of the preform that is used has been thermally crystallized.

Moreover, the stretch-blow forming can be conducted under the known forming conditions so far as there can be used the metal bottom mold that is capable of imparting the above-mentioned shape to the bottom portion. Namely, there can be employed a one-step blow forming as well as a two-step blow forming, and it is desired that the heat setting has been executed from the standpoint of imparting the heat resistance.

INDUSTRIAL APPLICABILITY

The synthetic resin container of the present invention is imparted in the bottom portion thereof with a function for reducing and absorbing pressure so will not to affect the appearance of the container. Therefore, the synthetic resin container of the present invention can be effectively used as a container for containing seasonings and the like, which is establishing such an image that the container can be hot-filled and permits a roll label to be stuck to the body portion.

The container of the invention can also be used for containing the contents that are hot-filled at relatively high temperatures in addition to containing the above contents.

DESCRIPTION OF REFERENCE NUMERALS

1 synthetic resin container
2 mouth portion
3 shoulder portion
4 body portion
5 bottom portion
6 ribs
8 leg portion
9 raised bottom portion
10 central portion
12 arcuate protuberances
13 arcuate dents
14 annular curved portions
15 divided protuberances
16 branched dents

The invention claimed is:

1. A synthetic resin container forming, in a bottom portion thereof, an outer circumferential wall that is continuing from a body portion, an annular leg portion inclusive of a grounding portion and an inner circumferential wall, and a raised bottom portion positioned over said grounding portion on the inside of the inner circumferential wall of said leg portion, wherein said raised bottom portion is protruding downward beyond a root portion where said leg portion is continuing to the inner circumferential wall, a plurality of arcuate protuberances are formed in a spiral shape heading from an outer edge of the central portion of said raised bottom portion toward an outer circumferential side, and arcuate dents are formed among the arcuate protuberances that are neighboring each other, and said arcuate dents have branched dents that extend in a direction nearly opposite the spiraling direction and toward the outer circumference on the outer circumferential side in the radial direction, and divided protuberances are formed between said arcuate dents and said branched dents.

2. The synthetic resin container according to claim 1, wherein a plurality of annular curved portions are formed in said arcuate protuberances and in said arcuate dents, said plurality of annular curved portions being concentric with said central portion and curving downward.

3. The synthetic resin container according to claim 1, wherein the centers of said arcuate dents and of said branched dents at the outer ends thereof in the direction of width are arranged maintaining an equal distance at the end on the outer circumferential side of the raised bottom portion.

4. The synthetic resin container according to claim 1, wherein the central portion of said raised bottom portion is protruding downward or upward.

5. The synthetic resin container according to claim 1, wherein said arcuate dents and said branched dents have rough surfaces.

6. The synthetic resin container according to claim 1, wherein said arcuate protuberances have rough surfaces.

7. The synthetic resin container according to claim 1, wherein the inner circumferential wall of said leg portion has a rough surface.

* * * * *